US006406663B1

(12) United States Patent
Göransson

(10) Patent No.: US 6,406,663 B1
(45) Date of Patent: Jun. 18, 2002

(54) METHOD AND APPARATUS FOR COMPACTING A POWDER MATERIAL INTO A HOMOGENOUS ARTICLE

(75) Inventor: Bo Göransson, Göteborg (SE)

(73) Assignee: SKF Nova AB, Goteborg (SE)

( * ) Notice: Subject to any disclaimer, the term of this patent is extended or adjusted under 35 U.S.C. 154(b) by 0 days.

(21) Appl. No.: 09/839,150

(22) Filed: Apr. 23, 2001

(51) Int. Cl.[7] ..... B22F 7/00
(52) U.S. Cl. ..... 419/38; 425/78
(58) Field of Search ..... 419/38; 425/78

(56) References Cited

U.S. PATENT DOCUMENTS

| | | | | | |
|---|---|---|---|---|---|
| 3,647,333 | A | * | 3/1972 | Smith | 425/78 |
| 4,518,335 | A | | 5/1985 | Pujari | |
| 5,897,826 | A | * | 4/1999 | Lashmore et al. | 264/437 |
| 6,241,935 | B1 | * | 6/2001 | Beane et al. | 264/437 |

FOREIGN PATENT DOCUMENTS

| | | |
|---|---|---|
| DE | 31 28 347 | 2/1983 |
| EP | 0 446 665 | 9/1991 |
| GB | 1 304 162 | 1/1973 |
| WO | 98/35806 | 8/1998 |

OTHER PUBLICATIONS

U.S. Patent Application No. 09/749,814, "A Method and a Device for Compacting of Powder Metal Bodies", Bo Göransson, filed Dec. 28, 2000.

U.S. Patent Application No. 09/977,933, "A Method and Apparatus for Compacting a Powder Material Into a Homogenous Article", Peter Nordell et al., filed Oct. 17, 2001.

* cited by examiner

*Primary Examiner*—Daniel J. Jenkins
(74) *Attorney, Agent, or Firm*—Burns, Doane, Swecker & Mathis, L.L.P.

(57) ABSTRACT

A method and corresponding device for compacting a powder material into a homogenous article. The method includes the steps of, placing the powder material in a molding cavity connected to a gas source, blowing gas into the lower end of the molding cavity so that the particles in the powder material are suspended in a gas stream, sealing the upper end of the molding cavity by an upper pressing punch, connecting the lower end of the molding cavity to a vacuum source, sealing the connection to the vacuum source by moving a lower punch relative to the lower end portion of the molding cavity, and thereafter compacting the powder material with the help of the pressing punch. The apparatus for performing the method includes a molding cavity having sidewalls, an upper and lower punch moveable within the molding cavity an opining in communication with the molding cavity for blowing gas into, and sucking gas out of the cavity, wherein the lower punch is moveable between a first position in which an upper end surface of the punch is located below the opening, to a second position in which the opening is covered by a sidewall of the lower punch.

6 Claims, 1 Drawing Sheet

METHOD AND APPARATUS FOR COMPACTING A POWDER MATERIAL INTO A HOMOGENOUS ARTICLE

This application claims priority under 35 U.S.C. §§ 119 and/or 365 to 0001522-2 filed in Sweden on Apr. 27, 2000; the entire content of which is hereby incorporated by reference.

FIELD OF THE INVENTION

The present invention relates to a method and an apparatus for compacting a powder material into a homogenous article.

BACKGROUND OF THE INVENTION

In processes for manufacturing articles, such as bearing rings, bushes, solid bodies, etc, by compacting powder materials in a molding cavity it is essential that the powder be evenly distributed within the molding cavity before the start of the pressing operation. However, it is difficult to fill a molding cavity with powder so that the particles in the powder are uniformly distributed and so that the upper surface of the powder material filling the molding cavity is horizontal. Moreover, if the pressing operation takes place with a very high pressing rate, so that the pressing time is in the order of a few milliseconds, there is a great risk that air will become entrapped in the compacted article, disturbing the homogeneity thereof.

SUMMARY OF THE INVENTION

An object of the present invention is to solve these problems by providing a method and an apparatus for compacting a powder material into a homogenous article in which the particles in the powder are evenly distributed within the molding cavity and the upper surface of the powder in the molding cavity is horizontal before the start of the pressing step.

This object, and others are accomplished by a method for compacting powder material to form a homogenous article, comprising the steps of; placing the powder material in a molding cavity connected to a gas source, blowing gas into the lower end of the molding cavity so that the particles in the powder material are suspended in a gas stream; sealing the upper end of the molding cavity by an upper pressing punch, connecting the lower end of the molding cavity to a vacuum source; sealing the connection to the vacuum source by moving a lower punch relative to the lower end portion of the molding cavity; and thereafter compacting the powder material with the assistance of the pressing punch.

In a preferred embodiment the vacuum source creates a sub-pressure in the molding cavity of at least half the atmospheric pressure.

The invention relates also to an apparatus for compacting a powder material to form a homogenous article comprising a molding cavity having vertical side walls and open ends, and an upper and a lower punch having the same cross-sectional area as the molding cavity and being movable into and out of the molding cavity, an opening arranged in the side wall of the molding cavity in the lower end part thereof, said opening being connected to a device for blowing gas into and a device for sucking gas out of the molding cavity, the lower punch is movable relative to the molding cavity from a first position in which an upper end surface of the lower punch is located below the opening to a second position in which the opening is covered by a side wall of the lower punch.

In a preferred embodiment a gas-pervious membrane covers the opening, said membrane being impervious to the smallest of the particles in the powder material to be placed in the molding cavity. Preferably, the vertical walls of the molding cavity comprise an inner wall of a matrix having the form of a hollow cylinder, and the side wall of a cylindrical core pin concentrically located in the inner space defined by the hollow matrix. The upper and lower punch preferably have lower end surface and an upper end surface, respectively, comprising an annular flange fitting into the annular molding cavity. The opening preferably connected to a device for blowing gas therein and a device for sucking gas out of the molding cavity comprising an annular groove in the lower end portion of the inner wall of the matrix and/or the side wall of the core pin.

BRIEF DESCRIPTION OF THE DRAWINGS

The invention will now be described with reference to the enclosed drawing figures, of which.

DETAILED DESCRIPTION OF THE INVENTION

Figures 1, 2, 3:
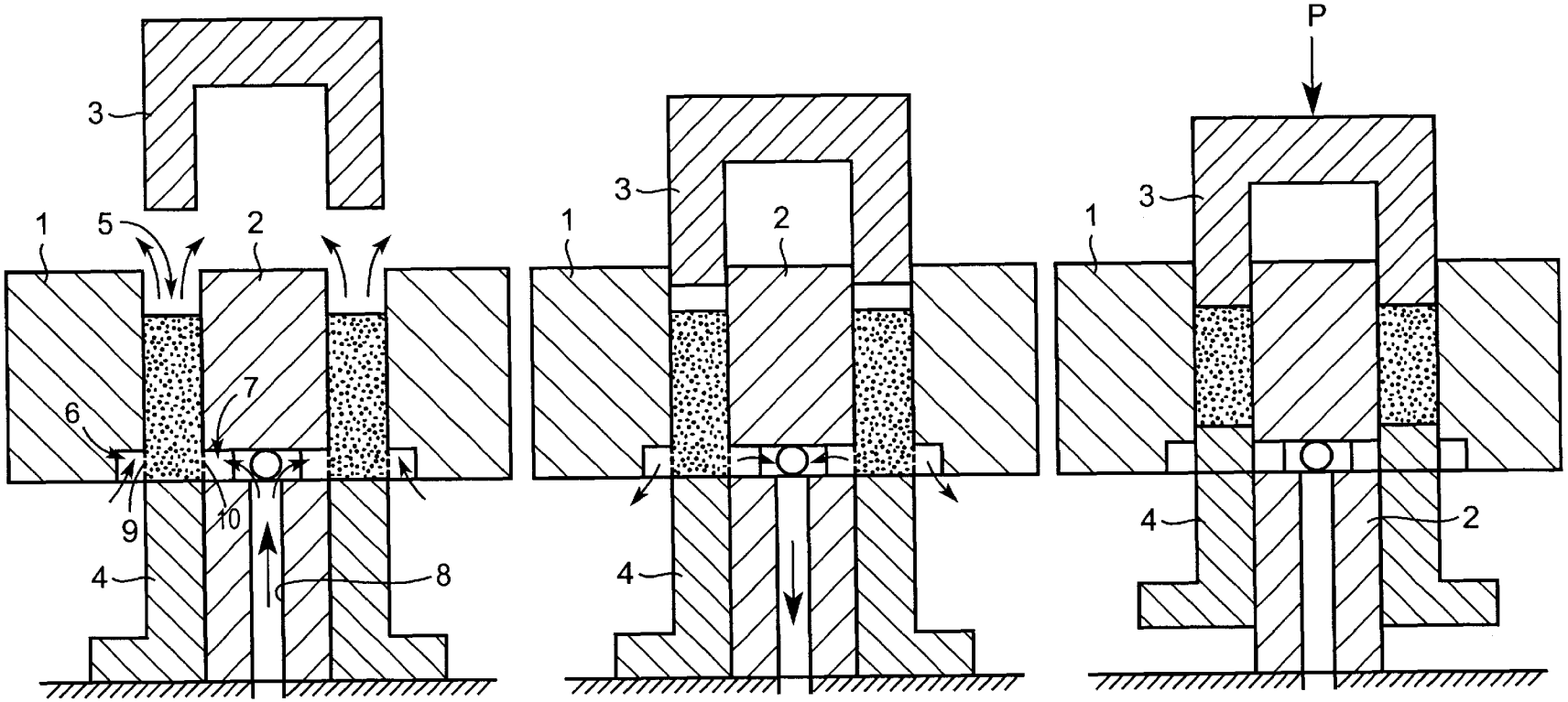
FIG. 1 schematically shows a cross-sectional view of an apparatus according to a preferred embodiment of the invention, during the fluidising step.
FIG. 2 shows the apparatus of FIG. 1 during the vacuum step, and FIG. 3 shoes the apparatus of FIG. 1, immediately before the start of the compacting step.

An apparatus for compacting powder into solid annular articles, such as bearing rings, is shown in FIGS. 1–3. The apparatus comprises a hollow cylindrical matrix 1, a core pin 2, an upper pressing punch 3 and a lower punch 4. The core pin 2 is cylindrical and concentrically disposed in relation to the matrix 1 so that the side walls of a molding cavity 5 are defined by the inner wall of the matrix and the side wall of the core pin. The bottom wall of the molding cavity 5 is defined by the upper end surface of the lower punch 4 having the form of a hollow cylinder fitting into the annular space between the inner side wall of the matrix and the side wall of the core pin. The upper punch 3 has the form of a hollow cylinder with a closed upper end.

The matrix 1 has an annular groove 6 in the lower end portion thereof. The groove 6, is by suitable conduits, in communication with a gas source (not shown in the Figures). Opposite to the groove 6 a similar annular groove 7 is made in the core pin 2. This groove 7 is also in communication with the gas source by suitable conduits. In the embodiment shown the groove 7 is connected to a central bore 8 by at least two radial bores. The central bore 8 is by a suitable conduit connected to the same gas source as the groove 6. The side of the respective groove 6,7 that is turned against the molding cavity 5 is closed by a gas-permeable membrane 9 and 10, respectively.

In FIG. 1 the apparatus is shown in the beginning of the compacting process immediately after powder material has been introduced into the molding cavity 5. In order to accomplish an even distribution of the particles in the powder material filled into the molding cavity, gas is blown into the molding cavity by the gas source, as is indicated by arrows in FIG. 1. The flow rate of the gas is such that a fluidised bed is accomplished, i.e. the particles in the powder material are suspended by the gas flow. Thereby an even distribution of the particles in the powder material and a horizontal upper particle surface will be established. The flow rate for creating a fluidised bed is dependent of the density, size and form of the particles in the powder material.

In the described embodiment the gas flow is created after the filling of the molding cavity with powder material. When the gas flow first reaches the bottom of the molding cavity, it has a stirring effect on the powder material in the molding cavity that ensures an even distribution of the particles in the powder material when a flow rate sufficient for suspending the particles of the powder material is reached. It is pointed out that the flow rate should be successively increased in order to avoid a sudden increase of pressure in the molding cavity, which might result in that some of the particles in the molding cavity will be thrown out from the molding cavity.

Alternatively, the gas flow in the molding cavity is created immediately before the molding cavity is filled with powder material. In such a case, the pressure drop over the molding cavity will successively increase during the filling of the molding cavity so there will be no risk of a sudden pressure increase therein.

In the case when the filling of the molding cavity takes place before the gas flow is created, the lower punch 4 is preferably moved upwards from the position shown in FIG. 1 so that the upper surface of the powder material filled into the molding cavity will lie flush with the upper surfaces of the core pin and the matrix. Superfluous powder material filled into the molding cavity can then be scraped off. Thereafter, the lower punch is moved downwards to the position shown in FIG. 1 and the gas flow is created.

The gas used can be air or an inert gas.

After having achieved a fluidising of the particles in the molding cavity 5, the gas flow is stopped. At the same time the upper punch 3 is moved downwards into the upper end of annular space so that the upper end of this space is sealed of from the surrounding atmosphere. The grooves 6 and 7 are put in communication with a vacuum source (not shown in the Figures). The gas in the molding cavity will thus be drawn out thereof and the evenly distributed particles in the powder material filling the mold will come into abutment with each other. The sub-pressure created in the molding cavity is at least half that of the atmospheric pressure. It is pointed out that the membranes 9, 10 is so fine that no particles can pass through the membranes into the grooves 6, 7. This step in the process of compacting a powder material into a homogenous article is shown in FIG. 2, the sucking of gas out of the molding cavity being indicated by arrows.

In order to ensure the sealing of the molding cavity from the surrounding atmosphere during the during the sub-pressure step, it usually appropriate to provide sealing elements (not shown in the figures) between the matrix and the upper and lower punch, respectively. The sealing element for the lower punch is preferably fixed to the matrix whereas the sealing element for the upper punch is slidably attached to the upper punch and pretensioned to a position in which the sealing element lies flush with the lower surface of the upper punch.

Thereafter, the lower punch 4 is moved upwards such a distance that the grooves 6, 7 are covered by the outer side wall thereof and the grooves 6, 7 are disconnected from the vacuum source. The powder material in the molding cavity will move upwards together with the lower punch 4 and in the end position of the lower punch, which is shown in FIG. 3, the upper surface of the powder material is in abutment with the lower end surface of the upper punch 3.

The apparatus is now ready for the compacting of the powder material in the molding cavity and the pressing punch 3 is driven downwards with a force P, as indicated by an arrow in FIG. 3. The pressing punch is driven with a very high pressing rate, the pressing operation will only take a few milliseconds.

The lower punch 4 is advantageously arranged to eject the compacted article out of the molding cavity 5 after the pressing step has been performed.

In the embodiment described openings 9, 10 are present in both the matrix and the core pin. In an alternative embodiment (not shown), the openings are only provided in the matrix. In such a case it is possible to make the matrix movable in relation to the lower punch in order to open and close this opening. Such an alternative construction would facilitate the support of the lower punch during the pressing operation.

As stated in the beginning, the invention can also be performed for compacting articles into solid bodies, such as a cylinder. In such a case, the apparatus does not include a core pin so that openings would only be present in the matrix, which then preferably is movable in relation to the lower punch in order to close and open the openings to the molding cavity.

The embodiment described can be modified in several ways within the scope of the invention. The grooves 6, 7 can for example be connected to different gas and vacuum sources, but preferably they are connected to the same gas and vacuum source. The respective gas and vacuum source can for example be the outlet and the inlet, of a blower but it is also possible to use separate sources for creating the flow of gas and the vacuum. Moreover, the molding cavity can have another form so that articles with other shapes than rings can be made, for example tubes with a rectangular or U-shaped section. The invention should therefore only be restricted by the wording of the enclosed patent claims.

While the present invention has been described by reference to the above-mentioned embodiments, certain modifications and variations will be evident to those of ordinary skill in the art. Therefore the present invention is to be limited only by the scope and spirit of the appended claims.

What is claimed is:

1. A method for compacting powder material to form a homogenous article, comprising the steps of;

placing the powder material in a molding cavity connected to a gas source, blowing gas into the lower end of the molding cavity so that the particles in the powder material are suspended in a gas stream;

sealing the upper end of the molding cavity by an upper pressing punch, connecting the lower end of the molding cavity to a vacuum source;

sealing the connection to the vacuum source by moving a lower punch relative to the lower end portion of the molding cavity; and thereafter compacting the powder material with the assistance of the pressing punch.

2. The method according to claim 1, wherein the vacuum source creates a sub-pressure in the molding cavity which is half that of atmospheric pressure or less.

3. An apparatus for compacting a powder material to form a homogenous article comprising a molding cavity having vertical side walls and open ends, and an upper and a lower punch, each punch having the same cross-sectional area as the molding cavity and each punch being movable into and out of the molding cavity, an opening arranged in the side wall of the molding cavity in the lower end part thereof, said opening being connected to a device for blowing gas into and a device for sucking gas out of the molding cavity, the lower punch is movable relative to the molding cavity from a first position in which an upper end surface of the lower punch is located below the opening to a second position in which the opening is covered by a side wall of the lower punch.

4. The apparatus according to claim 3, further comprising a gas-pervious membrane covering the opening, said membrane being impervious to the smallest of the particles in the powder material to be placed in the molding cavity.

5. The apparatus according to claim 4, wherein the side walls of the molding cavity comprise the inner wall of a matrix having the form of a hollow cylinder and the side wall of a cylindrical core pin concentrically located in the inner space defined by the hollow matrix, and the upper and lower punch have a lower end surface and an upper end surface, respectively, comprising an annular flange fitting into the annular molding cavity, the opening connected to a device for blowing gas into and a device for sucking gas out of the molding cavity comprising an annular groove in the lower end portion of the inner wall of at least one of the matrix and the side wall of the core pin.

6. A method for compacting powder material to form a homogenous article, comprising the steps of:

placing the powder material in a molding cavity connected to a gas source, blowing gas into the lower end of the molding cavity so that the particles in the powder material are suspended in a gas stream;

sealing the upper end of the molding cavity by an upper pressing punch, connecting the lower end of the molding cavity to a vacuum source;

sealing the connection to the vacuum source by moving a lower punch relative to the lower end portion of the molding cavity;

establishing a sub-pressure in the molding cavity, the sub-pressure at least half that of atmospheric pressure; and thereafter compacting the powder material with the assistance of the pressing punch.

* * * * *